US008276510B2

(12) United States Patent
Kosciesza

(10) Patent No.: US 8,276,510 B2
(45) Date of Patent: Oct. 2, 2012

(54) DAMPENING SYSTEM HOUSING

(75) Inventor: Hary Kosciesza, Borchen (DE)

(73) Assignee: Technotrans AG, Sassenberg (DE)

( * ) Notice: Subject to any disclaimer, the term of this patent is extended or adjusted under 35 U.S.C. 154(b) by 560 days.

(21) Appl. No.: 12/464,548

(22) Filed: May 12, 2009

(65) Prior Publication Data

US 2009/0282995 A1 Nov. 19, 2009

(30) Foreign Application Priority Data

May 16, 2008 (DE) ..... 10 2008 023 877

(51) Int. Cl.
*B41L 23/08* (2006.01)

(52) U.S. Cl. ..... 101/147; 101/148
(58) Field of Classification Search ..... 101/147
See application file for complete search history.

(56) References Cited

U.S. PATENT DOCUMENTS

| | | | |
|---|---|---|---|
| 4,831,927 | A | 5/1989 | Lin |
| 6,192,796 | B1 | 2/2001 | Hansson |
| 6,899,406 | B2 | 5/2005 | Krispin et al. |
| 6,901,853 | B2 | 6/2005 | Baldy et al. |

FOREIGN PATENT DOCUMENTS

| | | | | |
|---|---|---|---|---|
| DE | 1934710 | U | | 3/1966 |
| DE | 1490515 | B1 | | 7/1971 |
| DE | 1934710 | A | * | 4/1980 |
| DE | 3004271 | C2 | | 8/1981 |
| DE | 19811554 | C1 | | 4/1999 |
| DE | 20018740 | U1 | | 12/2000 |
| DE | 10317470 | B4 | | 11/2004 |
| DE | 69835545 | T2 | | 8/2007 |
| DE | 19811554 | C1 | | 7/2009 |
| EP | 1009633 | B1 | | 6/2000 |
| EP | 1273440 | B1 | | 1/2003 |
| GB | 2069767 | A | | 8/1981 |

* cited by examiner

*Primary Examiner* — Joshua D Zimmerman
(74) *Attorney, Agent, or Firm* — Richard M. Goldberg

(57) ABSTRACT

A method for producing a dampening system housing, includes the steps of providing a longitudinal housing element prepared from a flat component, making available two side parts with grooves for accommodating the longitudinal housing element, inserting the longitudinal housing element in the grooves and sealing the longitudinal housing element in the grooves, as well as a correspondingly produced dampening system housing.

15 Claims, 6 Drawing Sheets

DAMPENING SYSTEM HOUSING

FIELD OF INVENTION

The invention relates to a dampening system housing, a moistening device of a spray dampening system for printing presses with such a dampening system housing, and to a method for producing such a dampening system housing.

BACKGROUND INFORMATION AND PRIOR ART

Dampening systems are used in printing technology. Usually, dampening systems are devices with a series of mutually contacting rollers, which apply a fountain solution (generally water and several additives) uniformly on a printing plate.

Dampening systems may apply the fountain water over a dampening fountain, over nozzles or in a similar way, for example, on a fountain roller and then convey it as a film of water uniformly over all rollers to the printing plate. The dampening systems, for which nozzles are used, are also referred to as spray dampening systems.

Spray dampening systems usually have a spray beam, which carries spray valves and is mounted at a housing so that it can be shifted towards the roller or away from it for different purposes.

A spray dampening system of this type is known from the EP 1 009 633 B1. For the known device, the two ends of a spray beam are held so that the spray beam and, with that, the spray nozzles can be adjusted in relation to the roller.

The patent DE 698 35 545 T2 describes a spray dampening system, the spray beam of which is fastened pivotably at a spray space, which is installed securely. The spray dampening system is divided into two components, a spray space, which is installed securely at the printing press frame, and a rear, pivotable beam, in which the spray valves are located.

Further spray dampening systems are described in the DE 198 11 554 C1 and the DE 103 17 470 B4.

For the known spray dampening systems, the maintenance of the valves, the control of contamination in the spray space and the cleaning of the equipment are difficult in some cases. The installation of the spray dampening systems is expensive and, in some cases, can be adapted to circumstances only to a limited extent.

Conventional housings of dampening systems usually are assembled from several components. The sheet metal parts are bolted or welded to one another for producing the housings of the dampening systems. In some cases, it is cumbersome and expensive to produce the housings.

OBJECT OF THE INVENTION

It is an object of the invention to make available a dampening system housing, which is robust and can be produced advantageously, and a moistening device of such a dampening system for printing presses with such a dampening system housing, the moistening device being maintained and/or retrofitted easily, and a method for producing such a dampening system housing.

SUMMARY OF THE INVENTION

The objective is accomplished by the devices and methods of the independent claims. Advantageous embodiments are disclosed in the dependent claims.

A first aspect relates to a method for producing a dampening system housing, comprising the steps of:

- making available a longitudinal housing element, prepared from a flat component
- making available two side parts with grooves for accommodating the longitudinal housing element
- inserting the longitudinal element of the housing in the grooves
- sealing the longitudinal housing elements in the grooves.

The concept of a flat component refers to a raw material from which the longitudinal housing element is produced. A flat component may be a sheet metal part or a part with a geometry like that of sheet metal and made from a nonmetallic material. The dampening system housing may have an elongated shape. In the operating position of the dampening system at a printing press, the dampening system housing may extend essentially over the whole width of a cylinder of the printing press, which is to be cleaned. The side parts are disposed on both sides of the dampening system housing in the area of the axial ends of the dampening system housing. The longitudinal housing element extends between these axial end regions of the dampening system housing and forms the boundary of an interior space of the dampening system housing. The longitudinal housing element may be made in one piece or from several, individual, separated flat components. The longitudinal housing element may, for example, have an upper longitudinal housing part and a lower housing longitudinal part. The interior space of the dampening system housing may be configured so that a spray beam can be accommodated in the interior space. Moreover, in front of the spray beam in the direction of spraying, the dampening system housing may form the boundary of a spray space.

Such a method furthermore may comprise the following steps of:

- producing edges in the flat component, all edges, produced in the flat component, being disposed essentially parallel to one another.

The step of producing the edges may be accomplished by folding, that is, by reshaping, especially by bending along a tool edge of a folding tool. Such a method of producing a bending edge is suitable especially when the flat component is a sheet metal part. The step of producing the edges can be accomplished so that nonparallel bending edges are not produced.

Moreover, for such a method, the step of making available the side parts may comprise the following step:

- producing the side parts by injection molding.

The side parts may be produced in one part.

The step of making available the side parts furthermore may comprise the following step:

- production of the grooves, which are dimensioned in such a manner in relation to the material thickness of corresponding end regions of the longitudinal housing part that, after the end regions are inserted in the grooves, the fit between the end regions at the grooves is fountain solution-tight.

In that sense, the end regions of the longitudinal housing part are the regions which, upon insertion of the longitudinal housing element, are taken up by the grooves. During the step of producing edges in the flat component, the edges can be formed in such a way, that they are also formed at least partly at the end regions. Accordingly, the end regions may have at least partly the same cross sectional profile as the longitudinal housing element has elsewhere. Such a cross sectional profile may have L-shaped and/or U-shaped cross sectional profile regions. The grooves may have a cross section, corresponding to the cross-section of the end regions. The grooves may have a cross section, which corresponds to the cross-section of the end regions. In this connection, it may be sufficient to prepare the grooves during the production step with the appropriate fit only in the regions, in which a seal between the longitudinal housing element and the grooves is desired, for example, in the bottom region of the dampening system housing, in which fountain solution may collect during the operation of the dampening system. With such a design of the grooves, the step of sealing the longitudinal element or elements of the housing in the grooves may take place during and by the insertion of the longitudinal housing element in the grooves. The step of producing appropriately dimensioned grooves may take place, for example, during the production of the side parts in the injection molding process. It is furthermore conceivable that the grooves in the side part are produced, by a cutting method or that the grooves, which are prepared by injection molding in the side part, are finished in a further cutting step of the method, so that they have the desired fit. Alternatively or additionally to the appropriate configuration of the grooves, a sealer may be used in the grooves, in order to make available a seal in the joint region between the longitudinal housing element and the side parts of the finished dampening system housing. Such a sealing material may be made available, for example, in the form of a rubber lip and/or a liquid seal and/or by silicone. The sealing material may be made available before the housing element is inserted in the grooves or after the housing element has already been inserted in the grooves.

Such a method furthermore may comprise the following step:

fixing the flat components in the grooves especially by pinning and/or bolting and/or riveting and/or locking in position and/or transforming the end regions of the longitudinal housing part, which have been inserted in the grooves.

Moreover, holes, into which pins and/or screws and/or rivets, which prevent the longitudinal housing part being pulled out of the grooves, may be inserted transversely or perpendicularly to the insertion direction of the longitudinal housing part, may be provided, in the region of the side parts and/or at the end regions of the longitudinal housing part. The holes may be provided, for example, as blind holes. In relation to the pins that are to be inserted, the diameter of the blind holes may be dimensioned so that a pressfit is produced between the pins and the hole. For such pinning, the installation of the dampening system housing may be such that the dampening system housing can no longer be dismantled without destruction, which may be advantageous from a safety point of view. Furthermore, snap-in catches or other detent elements may be provided in the side parts and/or in the longitudinal housing part and when the longitudinal housing part is inserted in the grooves, bring about a fixation of the components. A fixation by transformation can be brought about, for example, by providing througholes, for example, in the region of the grooves, for example, in the base of the grooves, the throughholes extending through the side part in the insertion direction. Fishplate-like continuations, which are plugged through the throughholes during the insertion, may be provided in the end regions of the longitudinal housing element. After the insertion, the protruding part of the fishplate-like continuations can be bent over.

A second aspect relates to a method for producing a series of dampening system housings with different housing widths, comprising the steps of:

making available identical side part pairs for the dampening system housings of different width;

making available flat components of different widths for dampening system housings of different widths.

By this manufacturing method, the large number of variations of the components for the different constructions of the dampening systems can be reduced. Furthermore, mold construction costs can be lowered if the side parts are produced, for example, by injection molding.

Such a method of producing a series of dampening system housings may furthermore have the steps of one of the methods described in relation to the first aspect.

A third aspect relates to a dampening system housing of a spray dampening system, which was produced according to a method described in relation to the first and/or second aspect.

A fourth aspect relates to a dampening system housing of a spray dampening system having a longitudinal housing element and two side parts, wherein the longitudinal housing element has an elongated shape with two end regions, which are disposed in the longitudinal direction of the longitudinal housing element on mutually opposite sides of the longitudinal housing element, wherein the side parts in each case have at least one groove and wherein the end regions of the longitudinal housing elements are accommodated in the grooves so as to form a seal.

For such a dampening system housing, the side parts may be injection molded parts, especially plastic injection molded parts. Furthermore, the longitudinal housing element may have a sheet metal part.

For such a dampening system housing, the longitudinal housing element may have one or more longitudinal housing parts.

Furthermore, for such a dampening system housing, the longitudinal housing part or parts may be produced by a bending method, wherein at least one longitudinal housing part has several bending edges and wherein all bending edges of the at least one longitudinal housing part extend essentially parallel to one another. Other transformation or shaping methods may also be used instead of the bending method.

The end regions of such a dampening system housing may be pinned and/or bolted and/or glued in the grooves. Furthermore, a fixation may take place in the form described in relation to the first aspect.

A fifth aspect relates to a moistening device of a spray dampening system with a dampening system housing, described in relation to the third or fourth aspect, furthermore comprising a spray beam holding device and a spray beam, wherein the spray beam is connected over the spray beam holding device in such a manner with the dampening system housing, that the spray beam can be swiveled between a working position and a service position, wherein the spray beam in the service position has at least one degree of freedom in relation to the spray beam holding device, which enables the spray beam to be removed from the spray beam holding device, and wherein this at least one degree of freedom is taken from the spray beam while it is being swiveled into the working position.

The dampening system housing, which could also be referred to as the spray housing, may be fastened to a machine frame of the printing press or of the dampening system. The dampening system housing may extend parallel to and along the body that is to be moistened. The body to be moistened may be a fountain roller of the dampening system. Fountain solution spray nozzles, which, in the service position, may be freely accessible from outside of the dampening system housing, may be provided at the spray beam. In the art and also in the sense used here, the concept of degree of freedom describes the possibility of bodies moving in space. The concept is used frequently in conjunction with joints and describes the number and nature of possible movements, which the joint can carry out. In this connection, a body fundamentally has three rotational and three translational degrees of freedom in space. A joint exists if two bodies are connected with one another in such a way, that at least one of the six degrees of freedom is taken by the articulated relationship of the one body with the other. The degree of freedom of the spray beam in the service position may be a translational degree of freedom. In relation to the spray beam, the translational degree of freedom may be in the nozzle spraying direction in the service position. Without the degree or degrees of freedom in the service position, the spray beam in the working position may have a position, which is defined in relation to the dampening system housing and specifies a distance between the spray nozzles and the body, which is to be moistened. The working position is the position of the spray beam during the operation of the spray dampening system. The body to be moistened may, for example, be a roller that is to be moistened, especially a fountain roller of the spray dampening system.

A further embodiment relates to such a moistening device of a spray dampening system, for which the spray beam can be swiveled together with the spray beam holding device between the working position and the service position.

Moreover, for a further embodiment of such a moistening device, the spray beam holding device may have two essentially U-shaped profiles, each with two legs, wherein the spray beam in the service position is inserted into the U-shaped profiles and held displaceably between the legs of the U-shaped profiles. For this embodiment, the spray beam may be movable in the direction of a longitudinal extent of the legs, that is, in the removal direction. Accordingly, at least one translational degree of freedom (displaceability in the removal direction) can be made available. A different configuration of a longitudinal guide, which makes a translational degree of freedom in the removal direction available, is also conceivable. The translational degree of freedom in a removal direction may be directed in a direction, which is parallel to a radius, starting out from the pivot axis.

Furthermore, such a moistening device may have a configuration, for which the U-shaped profiles are disposed at a service flap in such a manner that, when the service flap is opened, the U-shaped profiles are swiveled together with the spray beam out of the dampening system housing into the service position. A service flap defines a flap at the dampening system housing of a moistening device, over which access to the spray beam can be assured for the purpose of the maintenance of the latter, etc. The service flap may extend essentially over the length of the spray beam.

Moreover, such a moistening device may have a configuration, for which the dampening system housing, in the working position of the spray beam, forms an essentially closed spraying space in front of the spray beam, when looked at in the spraying direction. In the region of the spraying space, the dampening system housing has an inspection flap, over which the spraying space is accessible from outside of the dampening system housing. In this connection, the inspection flap can be disposed so that the spray beam can be viewed in the working position. The spray pattern, contamination of the spraying space and/or the spray nozzles can be inspected over the inspection flap. The inspection flap may extend essentially over the length of the spray beam. Essentially closed refers to the operating state of the dampening system, for which the dampening system housing is disposed in the immediate vicinity of the body to be moistened, so that the body to be moistened blocks a spray opening in the dampening system housing, the spraying space on one side. The body to be moistened may, for example, be a fountain roller of a dampening system.

A further embodiment relates to such a moistening device, for which the at least one degree of freedom is taken from the spray beam as it is swiveled into the working position by swiveling a holding region of the spray beam into a guide opening of a positioning element. A holding region of the spray beam can be made available by means of an appropriate configuration of a spray beam cross section, corresponding to the cross section of the guide opening. For example, the cross section of the spray beam may be configured essentially rectangularly and the cross section of the guide region may have, for example, at least one flat contacting region, against which one side of the rectangular spray beam cross-section is placed in the service position. The flat contacting region may extend transversely or perpendicularly to the spray direction of the spray nozzles. The distance between the spray beam and, for example, the fountain roller in the spray direction can be specified by the contacting of the spray beam at the contacting region.

A sixth aspect relates to a moistening device of a spray dampening system, which has been described in relation to the third or fourth aspect, with a dampening system housing, furthermore comprising a positioning element and a spray beam, wherein the positioning element has an installation region and a contacting region and is installed exchangeably over the installation region at the dampening system housing and wherein the contacting region is configured so that the spray beam can be caused to lie in contact with the contacting region of the positioning element, so that the contact at the contacting region ensures a defined position of the spray beam in relation to the dampening system housing. The installation region refers to the region of the positioning element, over which the positioning element can be installed in the dampening system housing. The contacting region is a region with functional surfaces, at which touching contact between the spray beam and the positioning element can be made available. The contacting region may have surface regions, which are adapted to the contour of the spray beam in corresponding surface regions. The surface regions of the contacting region may correspond to the surface configuration of the spray beam in the holding region of the spray beam. For every spray beam, one or more positioning elements may be provided for positioning the spray beam in the dampening system housing. A positioning element may be configured, for example, panel shaped and/or installed at a side part of the dampening system housing. If there are several positioning elements for each spray beam, they may be provided, for example, on both sides of the dampening system housing at the ends of the spray beam. An arrangement in the central region of the spray beam in the working position thereof is also conceivable.

Such a moistening device may have a configuration, for which the moistening device has a fine adjustment device, over which the exchangeable installation of the positioning element at the dampening system housing can be brought about and over which the position of the positioning element with respect to the moistening system housing can be fine tuned. Such a fine adjustment device may be realized, for example, by bolting the positioning element using elongated holes. In this connection, the elongated holes may be disposed, for example, in the side parts of the dampening system housing and/or in the respective positioning element itself.

Such a moistening device may have a set of positioning elements, for which the contacting regions are in different positions to the installation regions, so that a coarse adjustment of the position of the spray beam in the dampening system housing can be made by the selection of the respective positioning element or elements. The positioning elements may be made available, for example, as essentially panel-shaped cast parts especially as injection molded parts. The positioning elements may be produced in one piece and/or from plastic.

A further embodiment relates to such a moistening device, for which the contacting region of the positioning element is provided in the region of a guide opening of the positioning element, into which the spray beam can be inserted in a working position and/or from which it can be removed.

A configuration of such a moistening device, which furthermore has the distinguishing features, described above in relation to the fifth aspect of the invention, is furthermore possible.

Furthermore, such a moistening device may have a configuration, for which the guide opening of the positioning element has an opening region with an opening width, which is larger than the corresponding width of the spray beam and wherein the guide opening has a basic region width, which corresponds to the corresponding width of the spray beam. The opening region refers to the region of the positioning element, through which the spray beam passes first, when it is swiveled into its working position. The basic region refers to the region of the positioning element, which surrounds the spray beam on both sides when the spray beam has reached its working position. For example, the spray beam may be clamped fast in this position owing to this configuration of the basic width.

Furthermore, for one embodiment of the moistening device, the guide opening of the positioning element may have an elastically deformable locking region, which fixes the spray beam in the working position thereof after it has been inserted completely. Such a locking region may be formed in one piece with the positioning element, for example, as a retaining element. An embodiment of the locking region as an independent component, which is mounted at the positioning element or provided and/or installed independently of the positioning element at the moistening device, is also conceivable.

In the following, individual embodiments of the invention are described by way of example. The individual embodiments described in some cases have distinguishing features, which are not absolutely essential for implementing the present invention; however, in general, they make generally desirable properties available in certain application cases. Accordingly, embodiments, which do not have all the distinguishing features of the embodiments described in the following, are also to be regarded as embodiments, which are disclosed by the teachings of the invention. Furthermore, in order to avoid unnecessary repetitions, certain distinguishing features are described only in relation to individual embodiments. It is pointed out that the individual embodiments are therefore not to be considered independently and, instead, individual embodiments may also be modified by the inclusion of individual or several distinguishing features of other embodiments. It is pointed out that a systematic combination of the individual embodiments with individual or several distinguishing features, which are described in relation to other embodiments, may be desirable and meaningful and should therefore be taken into consideration as well as regarded as included by the specification.

BRIEF DESCRIPTION OF THE DRAWINGS

In the Figures.

DETAILED DESCRIPTION OF THE DRAWING

Figure 1:
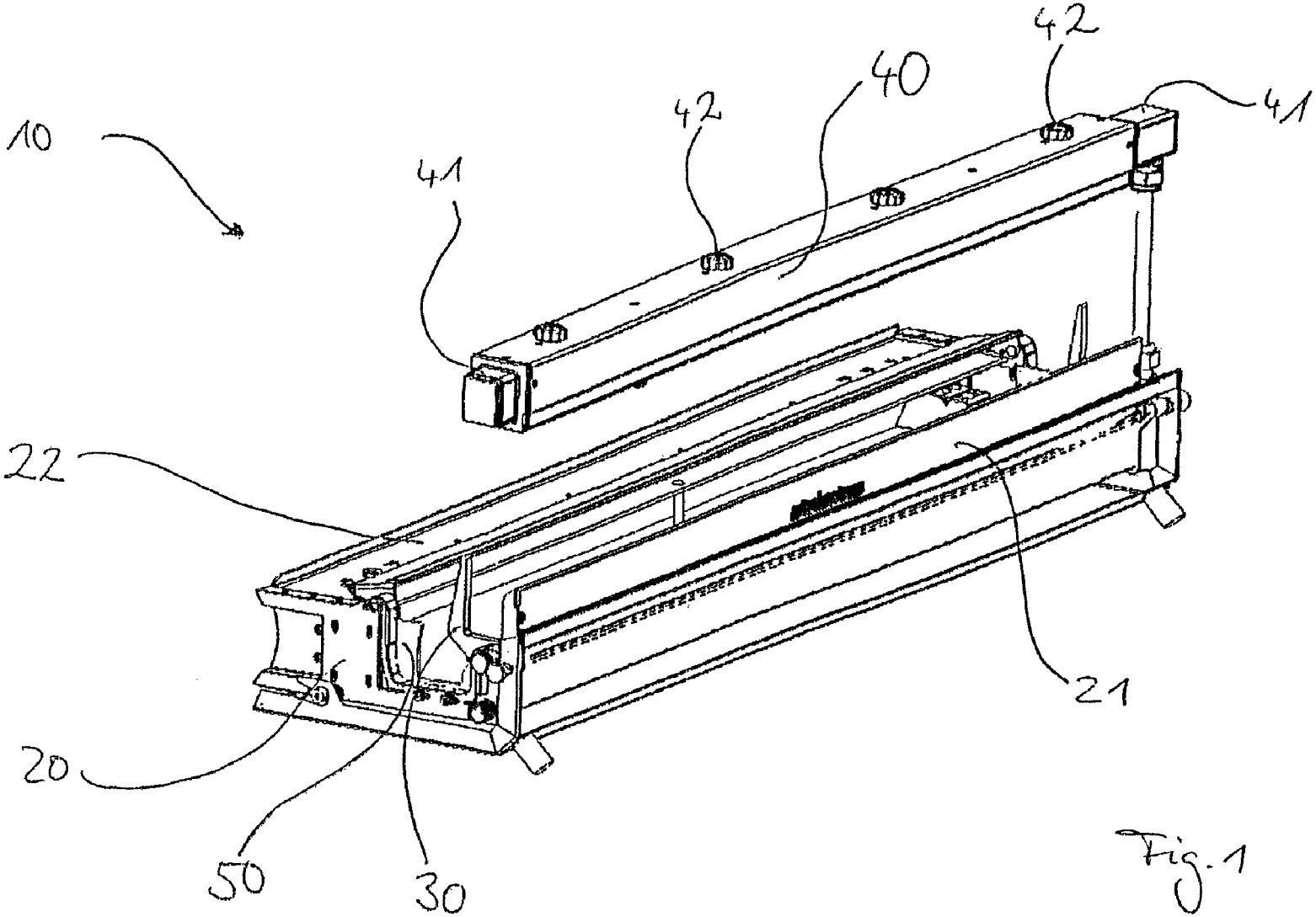
FIG. 1 shows a preferred embodiment of an inventive moistening device in an isometric view.

FIG. 1 shows a preferred embodiment of an inventive moistening device 10 in an isometric view.

In FIG. 1, the moistening device 10 is shown in a service position, in which a spray beam 40 was removed from a spray beam holding device 30.

In FIG. 1 and in the other Figures, the remaining parts of a spray dampening system or of a printing press, at which such a spray dampening system is disposed, are not shown. A fountain roller, which may be moistened, for example, by the moistening device 10, is therefore also not shown. However, it can be seen that a dampening system housing 20 of the moistening device 10 has a concave recess on the left side in FIG. 1. This concave recess matches the convex course of the surface of the fountain roller, so that the moistening device 10 can be brought into close proximity of the fountain roller.

The moistening device 10, shown in the service position, has in the rear part of the dampening system housing 20 a service flap 21, which is flipped open in the service position shown. Furthermore, in front of the spray beam 40 in the spraying direction of the latter, an inspection flap 22, through which the inner region of the spraying space 23 is accessible, is shown at the dampening system housing 20.

A spray beam holding device 30, which is formed as a fork-shaped holding device in the embodiment shown, is disposed at the service flap 21. The holding device may have an essentially U-shaped cross section and may be fastened, as shown in, in such a manner at the service flap 21, that the flipping open of the service flap causes the spray beam holding device 30 to deviate, so that a spray beam 40, inserted in the spray beam holding device 30, can be deviated into a service position.

It is also evident from this Figure that, at the two longitudinal ends thereof, the spray beam 40 has holding regions 41, which have essentially a rectangular cross section at both longitudinal ends. Moreover, two of the parallel sides of the rectangular cross-section correspond with the opening cross section of the spray beam holding device 30, which has the described U-shaped shaped cross-section in this embodiment. If the spray beam 40 is inserted over its holding region 41 into the spray beam holding device 30, it can be shifted more readily in the direction of the legs of the spray beam holding device 30 of the embodiment shown. On the other hand, it is fixed in the transverse direction hereto.

Figure 2:
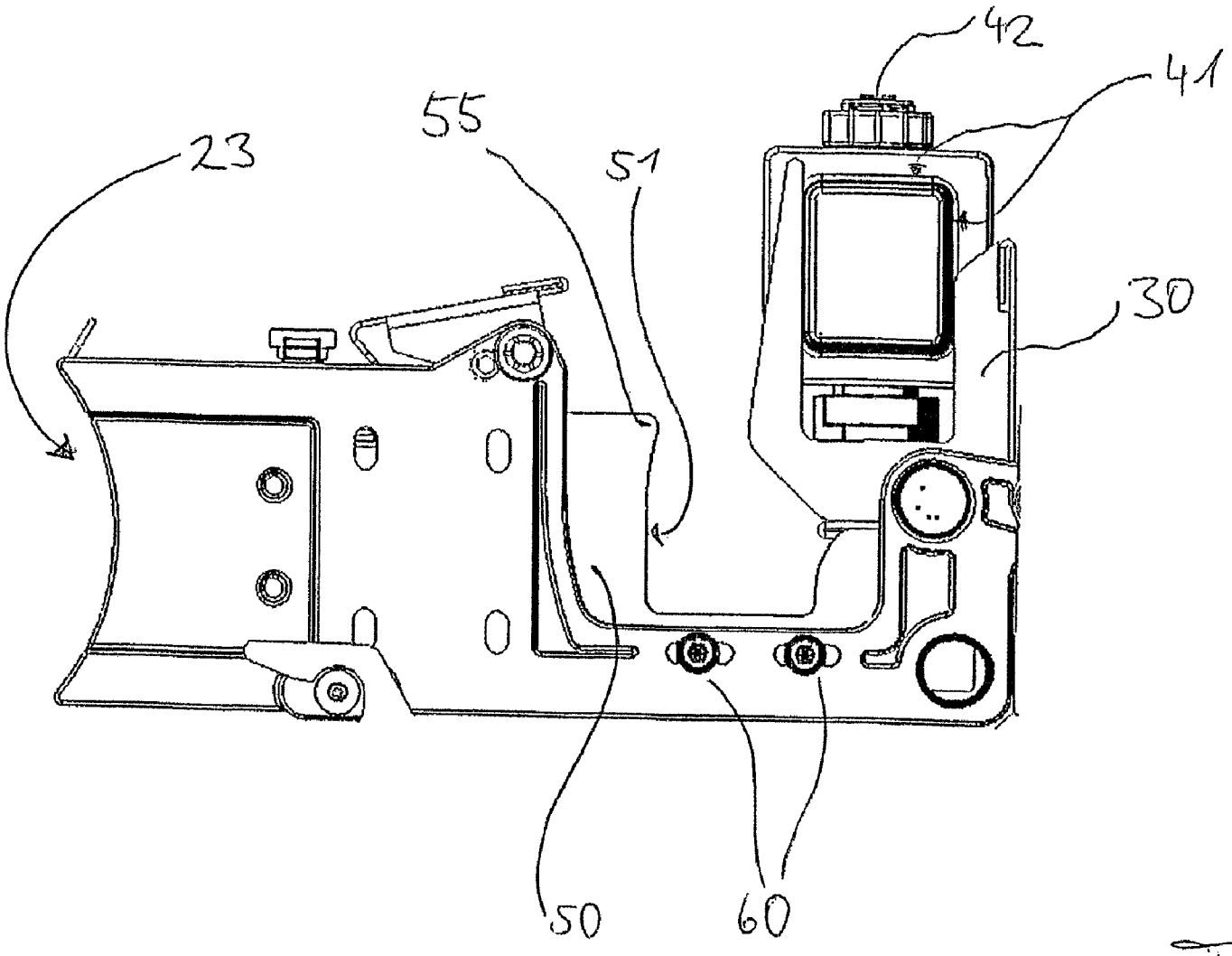
FIG. 2 shows a side view of an embodiment of the moistening device of the invention with a spray beam in the service position.

For the embodiment shown, the other two parallel sides of the rectangular cross section correspond to a guide opening 52, which is provided at a positioning element 50. Moreover, in the embodiment shown, a positioning element 50 is installed in each case on both longitudinal ends of the dampening system housing 20. As shown in FIG. 2, the guide opening 52 has a contacting region 51, which is contacted by one side of the holding region 41 when the spray beam 40 is swiveled into the working position. For this embodiment, the guide opening 52 shown has a further wall region on the opposite other side. The distance between this wall region and the contacting region 51 may correspond approximately to the width of the corresponding part of the holding region 41.

Figure 3:
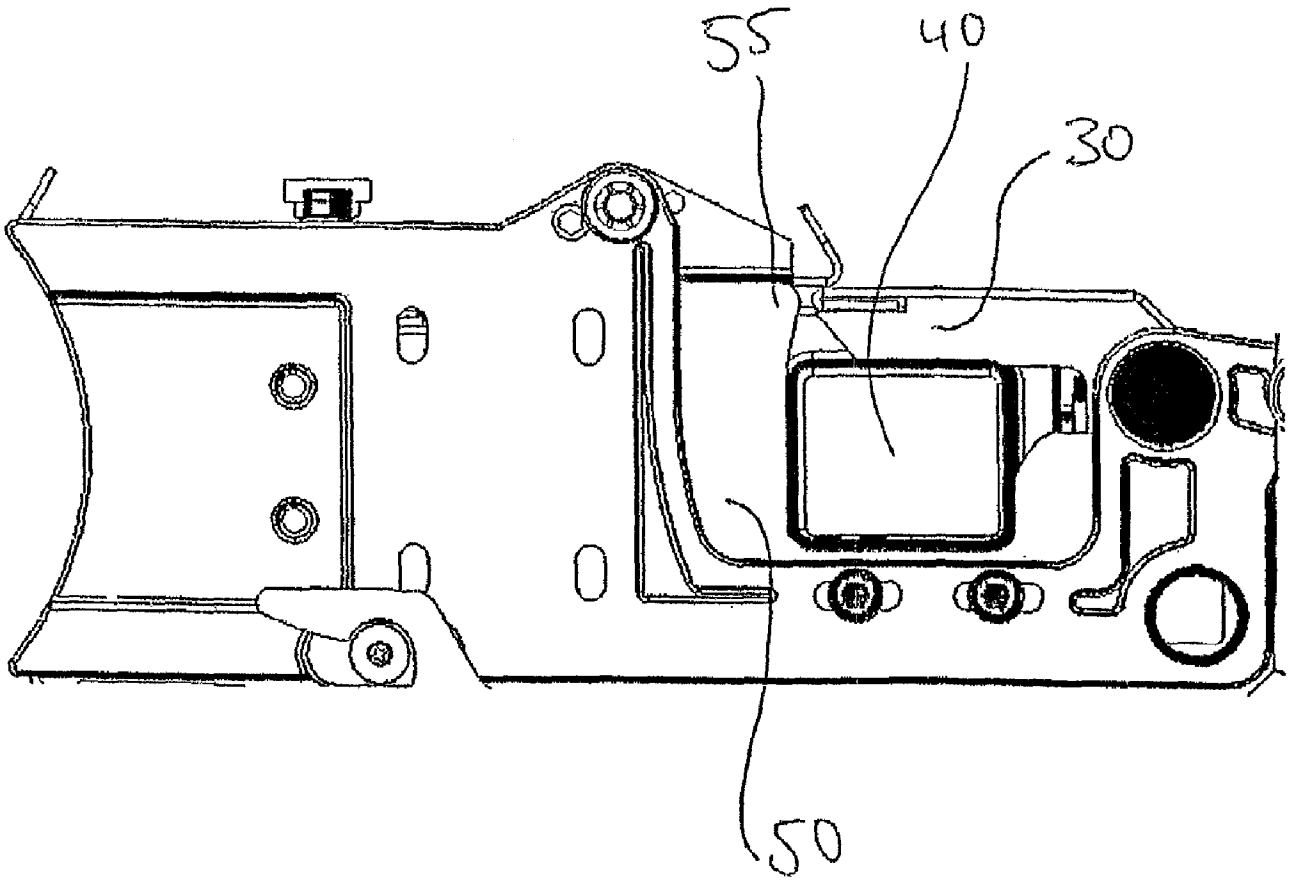
FIG. 3 shows a side view of an embodiment of the moistening device of the invention with a spray beam in the working position.

After the spray beam 40 has been swiveled into the working position, which is shown in FIG. 3, the holding regions 41 are swiveled into the guide opening 52 and, although the spray beam 40 is not fixed in the spray beam holding device 30 in the spray direction of the spray nozzles 42, it is fixed in this position also in the spray direction by the interaction of its holding region 41 with the guide opening 52. The displaceability, which the spray beam 40 still has in the spray beam holding device 30, accordingly is taken away when it is swiveled into the guide opening 52.

Figure 4:
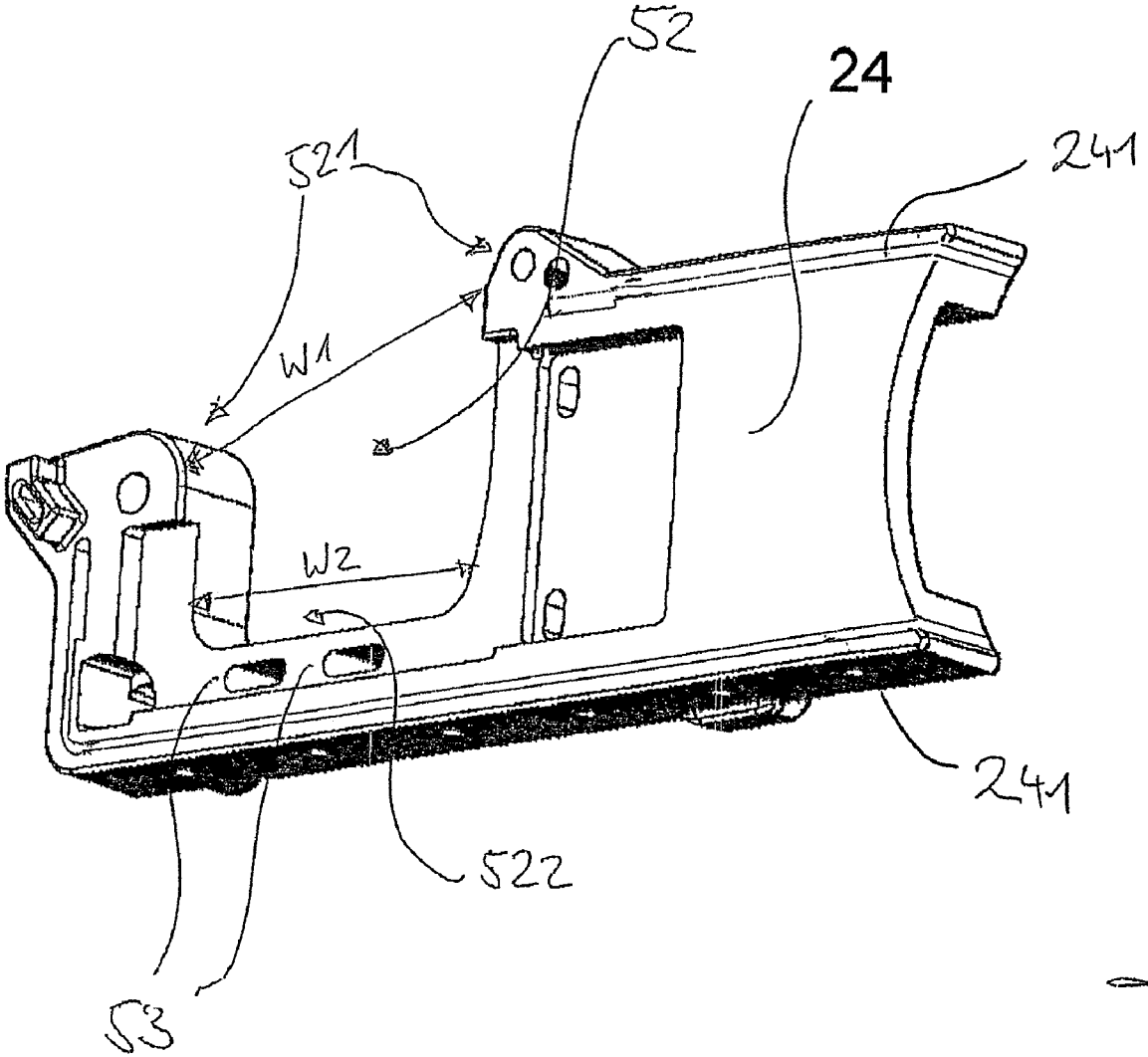
FIG. 4 shows an isometric view of a positioning element of the moistening device.

The exact position in the spraying direction, in which the spray beam 40 is fixed in this way in its working position, can be adjusted using a fine adjustment device 60. In the embodiment shown, the fine adjustment device 60 is realized by elongated holes in a side part of the dampening system housing 20 and by corresponding screws, with which the positioning element 50 is fixed in the dampening system housing 20. The elongated holes may also be provided additionally or alternatively at the positioning element 50, which, in the embodiment shown, is constructed as a panel-shaped element and produced in one piece from plastic by injection molding. The elongated holes in the positioning element 50 are shown in FIG. 4 and form an installation region 53.

Furthermore, a locking element 55, which locks the spray beam 40 in the positioning element 50, is provided for the positioning element 50 shown. The locking region 55 is shown in FIGS. 2 and 3. For the positioning element 50 shown, the wall region of the positioning element, which is opposite to the contacting region 51, is made clearly shorter, so that an opening region 521 is made available in the guide opening 52, which has an opening width W1, which is clearly larger than the width of the corresponding region of the holding region 41 of the spray beam 40. A base region 522, which has a basic width W2, which corresponds essentially to the corresponding width of the holding region 41, is formed at the base of the guide opening 52.

For a moistening device 10 or a dampening system housing 20, a set of positioning elements 50 can be made available, which has differently configured positioning elements 50. Such a different configuration may, for example, lie therein, that the contacting regions 51 of the respective positioning elements 50 have, in relation to the spraying direction of a spray beam 40, inserted in the positioning plate, a different distance from the respective installation region 53 of the respective positioning element 50.

Therefore, by selecting a suitable positioning element 50, a distance between the contacting region 51 and a surface of a fountain roller, which is to be moistened by the moistening device 10, can be preselected. An accurate positioning can then be accomplished over the fine adjustment device 60.

Figure 5:
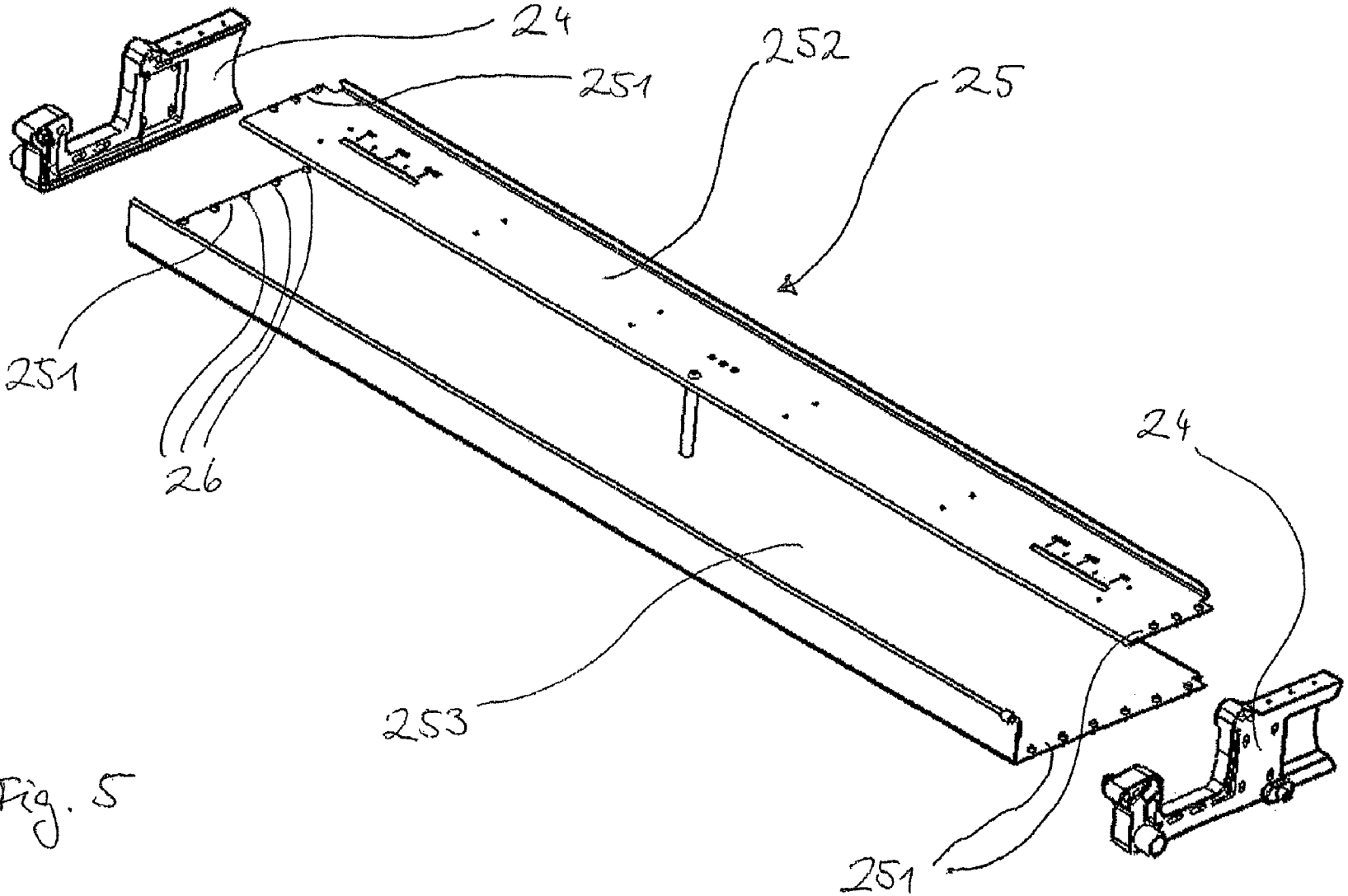
FIG. 5 shows components of a dampening system housing in an exploded view.

FIG. 5 shows components of the dampening system housing 20 in an exploded view. In the embodiment shown, the dampening system housing 20 has two side parts 24 and a longitudinal housing element 25, which, in the embodiment shown, is constructed in two parts. Accordingly, the elongated housing element 25 has an upper longitudinal housing part 252 and a lower longitudinal housing part 253. At their axial ends facing the side parts 24, the longitudinal housing parts 252, 253 each have an end region 251.

In the embodiment shown, the longitudinal housing parts 252, 253 are constructed as sheet metal parts. The sheet metal parts are produced from an essentially flat piece of sheet metal. Stainless steel, galvanized steel sheet, painted sheet metal, nonmetallic or similar materials, for example, come into consideration as material. Different recesses, such as holes, are produced in the end regions 251 of the sheet metal, for example, by stamping or other manufacturing methods. Furthermore, the sheet metal parts have edges 254, which are produced, for example, by folding at the sheet metal parts. The upper longitudinal housing part 252 has an essentially flat cross section. Only the side of the upper longitudinal housing part, facing a fountain roller in the operating position, has a short sheet-metal region, which is bent at an angle upward along a bending edge. The axial regions 251 do not have this short inclined region of the described course of the cross section. On the opposite side of the upper longitudinal housing part 252, the sheet-metal part is bent over along a bending edge in such a manner, that two layers of sheet metal come to lie parallel on one another in this region. The lower longitudinal housing part 253 has similar longitudinal edges and, in addition, is bent along a further edge 254, so that it has essentially an L-shaped cross section.

Furthermore, at appropriate places, the longitudinal housing element 25 may have appropriately configured regions, at which, for example, the inspection flap 22 or the service flap 21 may be mounted.

Each of the side parts 24 has grooves 241, into which the end regions 251 of the longitudinal housing parts 252, 253 may be inserted. In the region of the layers of sheet metal, lying on top of one another, the grooves 241, corresponding to the end regions 251 of the upper longitudinal housing part 252, have a correspondingly larger cross section. Furthermore, the grooves 241, corresponding to the end regions 251 of the lower longitudinal housing part 253, have an essentially L-shaped cross section.

Moreover, the side parts 24 have the installation regions 53, which have also already been described.

Figure 6:
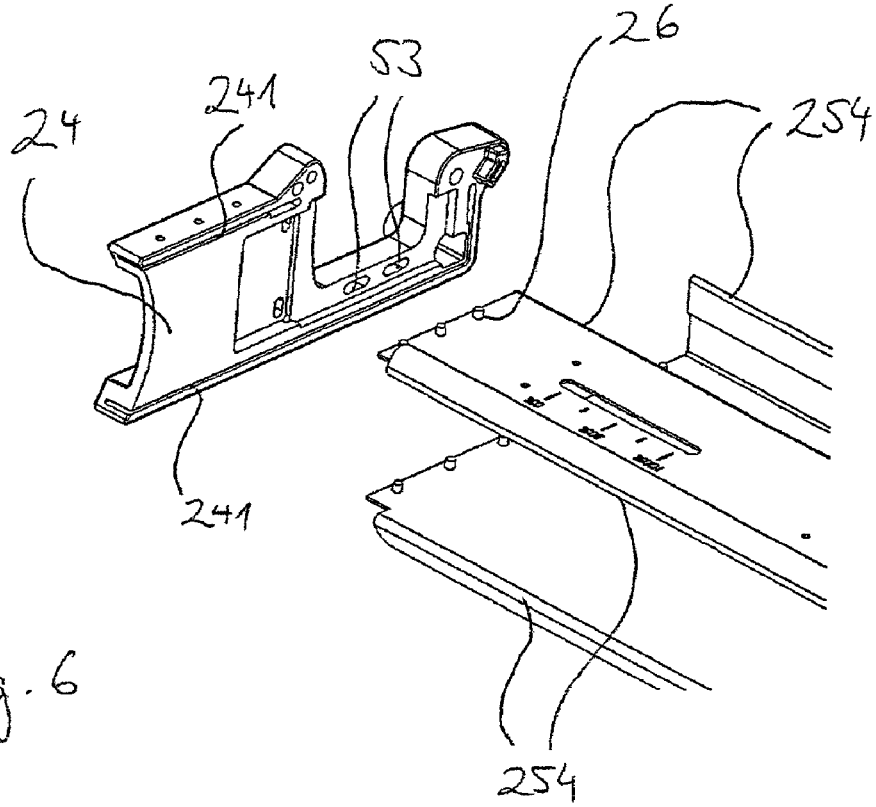
FIG. 6 shows a section of the exploded drawing of FIG. 5

In FIGS. 5 and 6, fixing elements 26 are shown at the end regions 251 of the housing. Contrary to the representation of FIGS. 5 and 6, they are installed only after the longitudinal housing element 25 is inserted in the grooves 241. In the embodiment, the fixing elements 26 are constructed as pins. Holes, which are aligned with one another only after the longitudinal housing element 25 is inserted in the grooves 241 and into which the pins are then inserted, are provided in the end regions 251 of the longitudinal housing parts 252, 523 as well as in the side parts. The holes in the side parts 24 may be constructed as blind holes. For illustration purposes, the fixing elements 26 are shown already in the exploded drawing in their position at the end regions 251.

FIG. 6 shows the section of the exploded drawing of FIG. 5, which is shown in FIG. 5 on the left side of the dampening system housing 20. In particular, the grooves 241 and the edges 254, which are provided at the longitudinal housing parts 252, 253, can be recognized better here.

Figure 7:
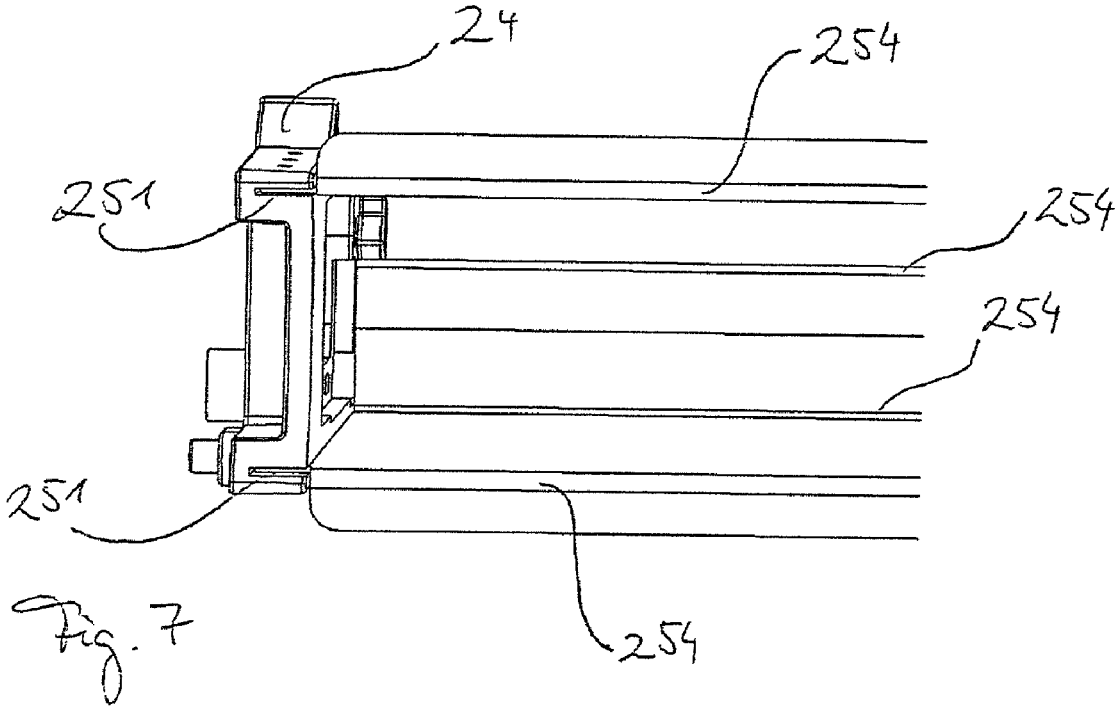
FIG. 7 shows the end of the dampening system housing, shown in FIG. 6, in an installed state.

The end of the dampening system housing 20, shown in FIG. 6, is shown in the assembled state in FIG. 7.

As can be seen in FIG. 7, the end regions 251 of the two longitudinal housing parts 252, 253, are constructed as continuations of the longitudinal housing parts 252, 253 in the embodiment shown. The end regions 251 are inserted in the grooves 241. The dimensions of the grooves 241 are such, that they lie close to the sheet-metal of the longitudinal housing parts 252, 253, so that dampening solution, which may collect during the operation of the moistening device 10 at least on the lower longitudinal housing part 253, cannot drop out of the dampening system housing 20 at these regions. The fit between the end regions 251 and the associated groove 241 can therefore be such that, at least in relation to the lower longitudinal housing part 253, this connecting region does not leak dampening solution. Alternatively or in addition, the sealing can also be brought about by additional sealing elements, which are not shown.

After the end regions 251 are inserted in the grooves 241, the longitudinal housing parts 252, 253 are fixed in their inserted position. For this purpose, fixing elements 26 are used, which are constructed as pins in the embodiment shown. The pins are inserted in the holes, which are constructed as blind holes in the present case, and through holes, which are constructed at the end regions 251, so that the end regions are fastened to the side parts 24. Tight and stable connecting regions are created by the combination of grooves 241, inserted sheet metal parts and the pinning.

Other fixing elements 26, such as rivets, screws or the like may also be used instead of the pins.

LIST OF REFERENCE SYMBOLS

10 Moistening device
20 Dampening system housing
21 Service flap
22 Inspection flap
23 Spray space
24 Side part
241 Groove
25 Longitudinal housing element
251 End region
252 Upper longitudinal housing part
253 Lower longitudinal housing part
254 Edge
26 Fixing element
30 Spray beam holding devise
40 Spray beam
41 Holding region
42 Spray nozzle
50 Positioning element
51 Contacting region
52 Guide opening
521 Opening region
W1 Opening width
522 Base region
W2 Base width
53 Installation region
55 Locking region
60 Fine adjustment device

What is claimed is:

1. A dampening system housing of a spray dampening system, comprising:
a longitudinal housing element and
two side parts,
wherein:
the longitudinal housing element has an elongated shape with two end regions, which, in a longitudinal direction of the longitudinal housing element, are disposed on mutually opposite sides of the longitudinal housing element,
each of the side parts has at least one groove and
the end regions of the longitudinal housing element are accommodated in the grooves and a liquid seal is formed by the end regions fitting in the grooves.

2. The dampening system housing of claim 1, wherein the side parts are injection molded parts, and the longitudinal housing element has a sheet-metal part.

3. The dampening system housing of claim 2, wherein the longitudinal housing element has at least one longitudinal housing part.

4. The dampening system housing of claim 3, wherein the at least one longitudinal housing part is produced by a bending method and at least one longitudinal housing part has several bent edges and all bent edges of the at least one longitudinal housing part extend essentially parallel to one another.

5. The dampening system housing of claim 1, wherein the end regions are at least one of:
pinned,
bolted, and
glued.

6. The moistening device of a spray dampening system with a dampening system housing of claim 1, furthermore comprising:
a spray beam holding device and
a spray beam,
wherein the spray beam is connected by the spray beam holding device with the dampening system housing in such a manner, that the spray beam can be swiveled between a working position and a service position and, in relation to the spray beam holding device, the spray beam in the service position has at least one degree of freedom, which enables the spray beam to be removable from the spray beam holding device and wherein this at least one degree of freedom is taken from the spray beam, when the latter is swiveled into the working position.

7. The moistening device of a spray dampening system with a dampening system housing of claim 1, furthermore comprising:
a positioning element and
a spray beam,
wherein the positioning element has an installation region and a contacting region and the positioning element is installed exchangeably via the installation region at the dampening system housing and the contacting region is configured in such a manner, that the spray beam can be brought into contact with the contacting region of the positioning element, so that, by the contact at the contacting region, a defined position of the spray beam in relation to the dampening system housing can be ensured.

8. The moistening device of a spray dampening system with a dampening system housing of claim 6, wherein the side parts are injection molded parts, and the longitudinal housing element has a sheet-metal part.

9. The moistening device of a spray dampening system with a dampening system housing of claim 8, wherein the longitudinal housing element has at least one longitudinal housing part.

10. The moistening device of a spray dampening system with a dampening system housing of claim 9, wherein the at least one longitudinal housing part is produced by a bending method and at least one longitudinal housing part has several bent edges and all bent edges of the at least one longitudinal housing part extend essentially parallel to one another.

11. The moistening device of a spray dampening system with a dampening system housing of claim 6, wherein the end regions are at least one of:
pinned,
bolted, and
glued.

12. The moistening device of a spray dampening system with a dampening system housing of claim 7, wherein the side parts are injection molded parts, and the longitudinal housing element has a sheet-metal part.

13. The moistening device of a spray dampening system with a dampening system housing of claim 12, wherein the longitudinal housing element has at least one longitudinal housing part.

14. The moistening device of a spray dampening system with a dampening system housing of claim 13, wherein the at least one longitudinal housing part is produced by a bending method and at least one longitudinal housing part has several bent edges and all bent edges of the at least one longitudinal housing part extend essentially parallel to one another.

15. The moistening device of a spray dampening system with a dampening system housing of claim 7, wherein the end regions are at least one of:

pinned,
bolted, and
glued.

* * * * *